US006814256B2

(12) United States Patent
Clark

(10) Patent No.: US 6,814,256 B2
(45) Date of Patent: Nov. 9, 2004

(54) CARTRIDGE BASED SMALL ITEM RESTRICTED ACCESS DISPENSER SYSTEM

(76) Inventor: Claude L. Clark, 2151 Old Oakland Rd., #144, San Jose, CA (US) 95131

( * ) Notice: Subject to any disclaimer, the term of this patent is extended or adjusted under 35 U.S.C. 154(b) by 202 days.

(21) Appl. No.: 10/024,680

(22) Filed: Dec. 19, 2001

(65) Prior Publication Data

US 2002/0074341 A1 Jun. 20, 2002

Related U.S. Application Data

(60) Provisional application No. 60/256,262, filed on Dec. 19, 2000.

(51) Int. Cl.[7] ..... G07F 11/00

(52) U.S. Cl. ..... 221/79; 221/87; 221/124; 221/129

(58) Field of Search ..... 221/87, 79, 124, 221/129, 130, 131

(56) References Cited

U.S. PATENT DOCUMENTS 4,819,802 A * 4/1989 Gutierrez ..... 206/387.15
4,821,917 A * 4/1989 Brown ..... 221/69
5,445,294 A * 8/1995 Gardner et al. ..... 221/1

* cited by examiner

*Primary Examiner*—David H. Bollinger
(74) *Attorney, Agent, or Firm*—Mark C. Jacobs

(57) ABSTRACT

A system for accessing small items that are stored in a secure manner for controlled access thereto by access mode or access code, which system is based upon a series of modules having a plurality of storage cartridges therein, which modules are disposed in a box and a plurality of boxes are housed in a cabinet. The cabinet and specific cartridge are accessed by an access mode such as a coin, bill, credit card, access code as by keypad or computer generated among others. A signal is sent to a solenoid which impacts a latch which moves downwardly and releases from engagement with the cartridge. A latch spring returns the latch to its original position. An ejection spring kicks the cartridge forward for the user to gain access to the contents thereof. Reinsertion of the cartridge reverses the procedure to re-engage the latch with the cartridge's down hanging metal strip.

13 Claims, 7 Drawing Sheets

CARTRIDGE BASED SMALL ITEM RESTRICTED ACCESS DISPENSER SYSTEM

FIELD OF THE INVENTION

This application pertains to a restricted access small item dispensing system, which may be accessed by coin receiver, bill insertion system, credit card reader, voice recognition system, keypad or other secure mode in order to address a specific cartridge within a module. This application discloses and claims subject matter disclosed in my earlier filed provisional application, Ser. No. 60/256,262 filed Dec. 19, 2000.

BACKGROUND OF THE INVENTION

The need for a secure dispensing system for small items such as keys, to permit access to car pool vehicles, access to city owned bicycles for use in crowded city centers, access to self service medicine chests for ambulatory patients at hospitals and other facilities; short messages for tenants in multi-occupant suites, the storage of tokens for use by patrons in coin operated machines such as copiers in public buildings such as libraries and country clerk offices; and the ability to access other small items for specific users has been well documented. This invention fills that need by providing a secure dispensing system that can be accessed by a plurality of means, such as but not limited to a 10-key keypad; a coin or bill insertion system, a credit card reader, off-site telephone keypad such as on a cell phone, or other secure access means such as fingerprint or voice recognition or eye discernment means. Access maybe limited to a single individual, or a class of persons depending upon the access code or access mode to be utilized to gain entrance to a cartridge.

The invention herein consists of a series of individually accessible cartridges placed within a module. Here five [5] cartridges are utilized but this is not a limiting number. Each module of five cartridges is disposed within a box that holds a plurality of modules and a plurality of boxes can be housed in a cabinet. The storage area of each cartridge is designated the chamber.

The invention accordingly comprises the device possessing the features properties and the relation of components which are exemplified in the following detailed disclosure and the scope of the application of which will be indicated in the appended claims. For a fuller understanding of the nature and objects of the invention reference should be made to the following detailed description, taken in conjunction with the accompanying drawings.

SUMMARY OF THE INVENTION

There is provided a secure access small item dispensing system that employs a plurality of cartridges each of which cartridges is capable of holding a small item to which access is to be limited to one person or a class of persons all of whom possess the access code or access mode, to cause the dispenser to release the cartridge from its holder for access to the contents. The apparatus comprising a storage cabinet having a plurality of boxes laid out in rows or columns, each of which boxes has a plurality of modules, each of which modules holds a plurality of cartridges therein.

The system uses any of several electronic signal inputs to actuate a release mechanism to cause the cartridge to be ejected from its module for access to the contents. Upon entry of the access code -E.G.- specific numbers on a keypad, or by use of the access mode, E.G. coin or bill insertion operation, an energized solenoid releases a latch that retains the cartridge in position within its housing in the module and a leaf spring urges it forward to be grabbed manually by the intended accessor. Upon insertion of the cartridge, or when returned into the slot, the physical force of urging the cartridge rearwardly, causes the cartridge to override a pawl of the latch pushing the pawl section downwardly, and a second leaf spring raises the pawl to its at rest position thus re-engaging the cartridge.

DESCRIPTION OF THE PREFERRED EMBODIMENT

A brief moment will be spent on the recital of the various aspects of this dispenser system for small parts. The invention herein consists at the lowest level of a series of individually accessible cartridges, of either plastic or metal, all of which are placed within a module. The number of cartridges may be arbitrarily chosen, but for illustrative purposes, five [5] cartridges per module are depicted, but this is not a limiting number. A series of cartridge loaded modules is disposed within a box that holds a plurality of modules these boxes may be oriented vertically or horizontally. A plurality of boxes can be housed in a cabinet. The storage area of the module that holds a single cartridge is designated as a cartridge receiver slot, and the storage area of an individual cartridge is designated the chamber.

Figure 1:
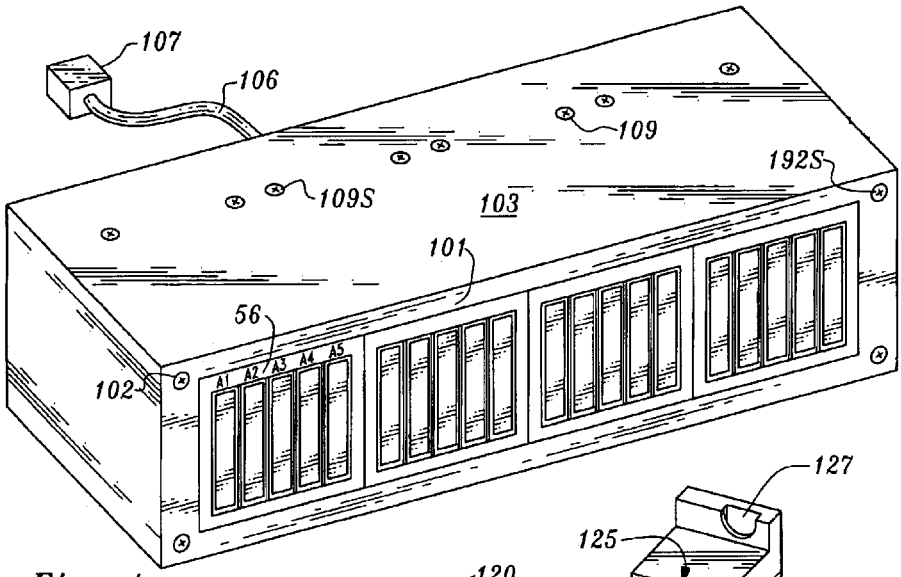
FIG. 1 is a front perspective of a single box with a multiplicity of cartridges within their respective cartridge housings.

In FIG. 1 there is shown a conventional 6-sided box 100 having as the front surface a faceplate 101, and having a top surface 103. This faceplate 101 is attached to the sidewalls through threaded aperture 102 which receives screws 192S.

These screws can be of the one way drive variety to impede vandalism. Top wall 103 has a series of spaced threaded apertures 109 for recipe of screws 109S, which screws mattingly engage apertures not seen on the individual module to retain the module in the box 100. Seen exiting the rear wall (not seen) is a line cord 106 with a suitable connector 107 thereon for attachment to a common source of power for all of the modules. Construction of the box 100 is deemed conventional and can be of any tamper resistant material such as hardwood, metal or plastics such as polycarbonate. A cartridge specific identification means 56, discussed elsewhere, is seen in part.

Figure 2:
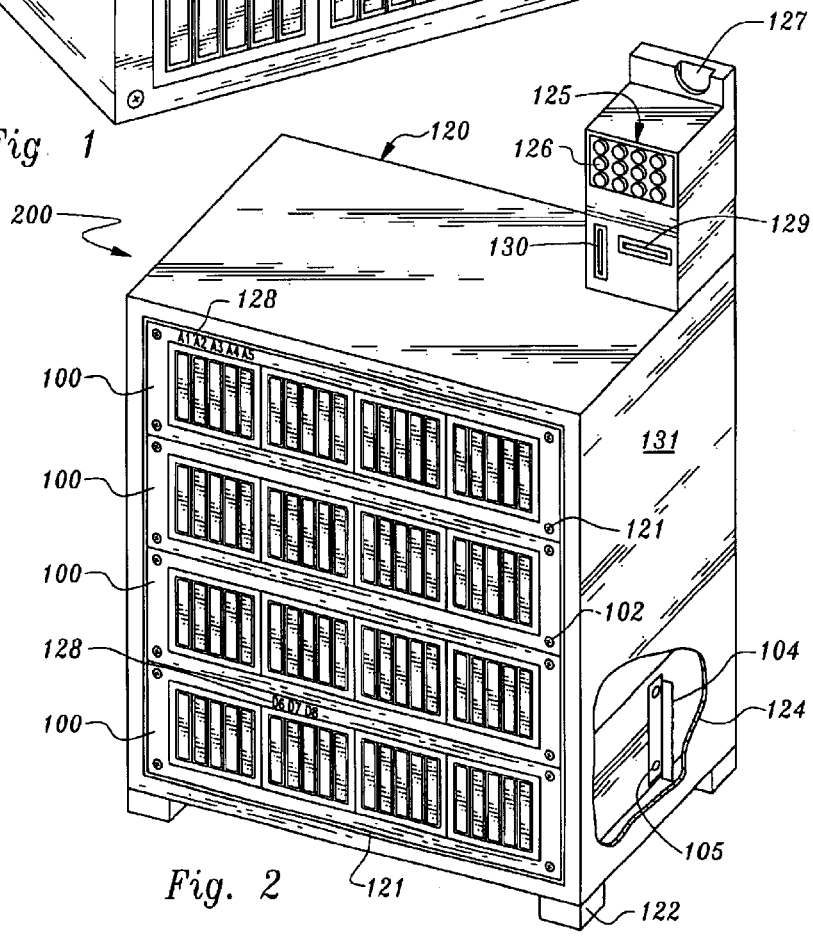
FIG. 2 is a perspective view of a storage cabinet housing a series of boxes of a plurality of modules forming a part of this invention.

In FIG. 2, is a perspective view, partially in cutaway at side opening 124 to illustrate the attachment of one box 100 to the sidewall 131 of cabinet 120 by flange plate 104. Other boxes 100 would be retained in the cabinet in like manner.

Designator 128 is an alphanumeric indicator for the identification of each separate cartridge in a module. By having such indicator system 56 have a light capability, storage in-use condition can be readily seen by users of the system. Identification means 56 is electrically connected to access point 125.

As mentioned earlier, access to the system of this invention 200 can be had by an actuating means set in motion by an access code or access mode. One example of an access code input device would be by the use of voice recognition software to a computer not seen, stored either in the cabinet or offsite and linked electronically to the cabinet 200. Another access code would be by remote land line or cellular telephone to the same computer. Access mode examples are seen implemented into access point 125, an electronic device coupled to the cabinet 200, having several sources of monetary input which include a coin slot 121, a credit card or debit card or other card, card reader 130 and a paper money receiver 129, said electronic device being electrically connected to the plurality of modules and each individual cartridge therein. Any of these can be used to access any cartridge similar to the accessing of a candy bar or cookies from a vending machine, wherein the software programming permits access to the next fall cartridge. Or in the alternative the money insert sources can be tied to the 10-key keypad 126 such that once money is credited, access can be had to a specific cartridge as opposed to a random cartridge. As a third alternative, the keypad could be used alone, with resort to money input. All of these modes of gaining access to a cartridge, be it specific or arbitrary are deemed to be within the skill of the art.

Figure 3:
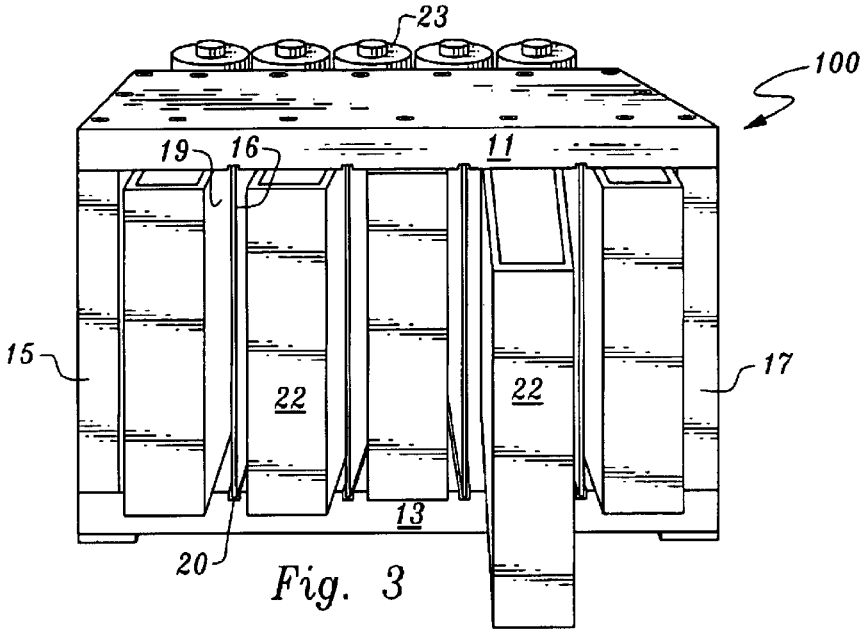
FIG. 3 is a front perspective view of one module of this invention.

In FIG. 3, the front of an individual module 10 is seen. This module 10 has a housing 12 with a top wall 11, a spaced bottom wall 13, spaced sidewalls 15 and 17 normal thereto, and a series of spaced separator walls 16 to define each cartridge slot 19 within the confines of the module. One cartridge slot 19 receives and retains one cartridge 22. The series of solenoids 23 are seen in part in the view as well. The front wall is open, but for the top and bottom walls each of which has elongated recesses aligned to receive separator walls 16.

In this FIG. 3, the front wall of a cartridge is 66 while the chamber for storage is designated 68, The balance of the construction of the cartridge will be discussed supra.

Figure 4:
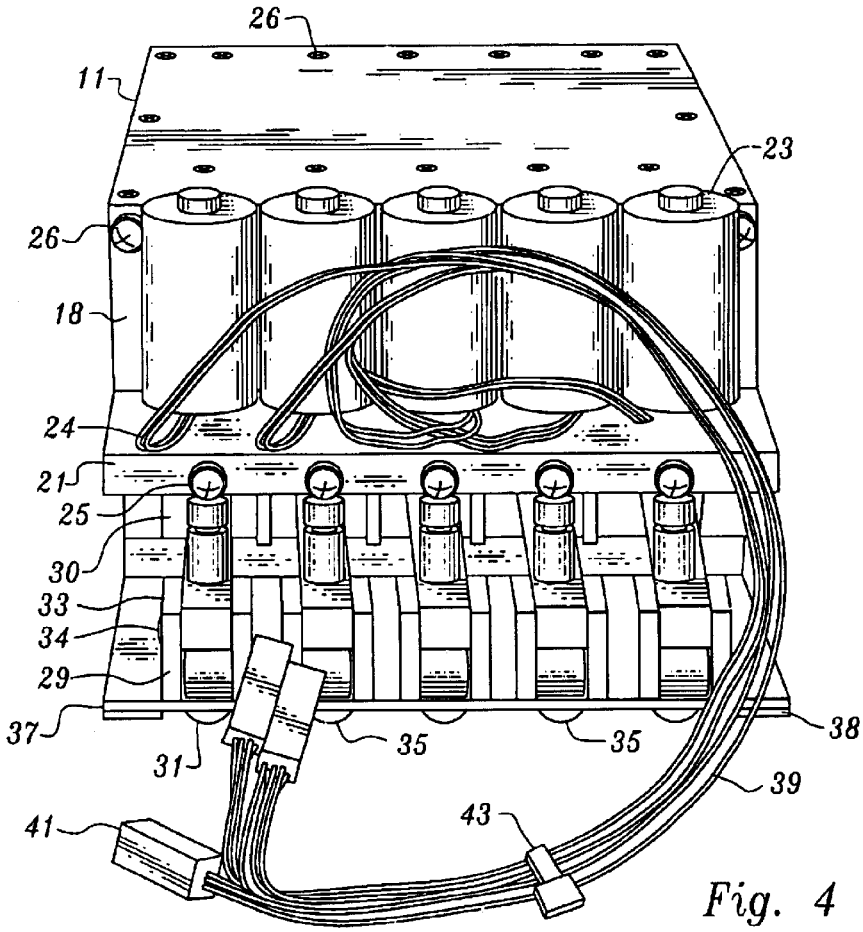
FIG. 4 is a rear to perspective view of one module of this invention.

In FIG. 4, a rear perspective view of the module of this invention, there is again seen the top wall 11, the back wall 18 attached by small screws 26. This back wall 18 extends downwardly but does not fully enclose the module at the rear thereof. The rear wall extends downwardly from the top to a point short of interfering with the operation of the latch disposed there beneath.

Figure 9:
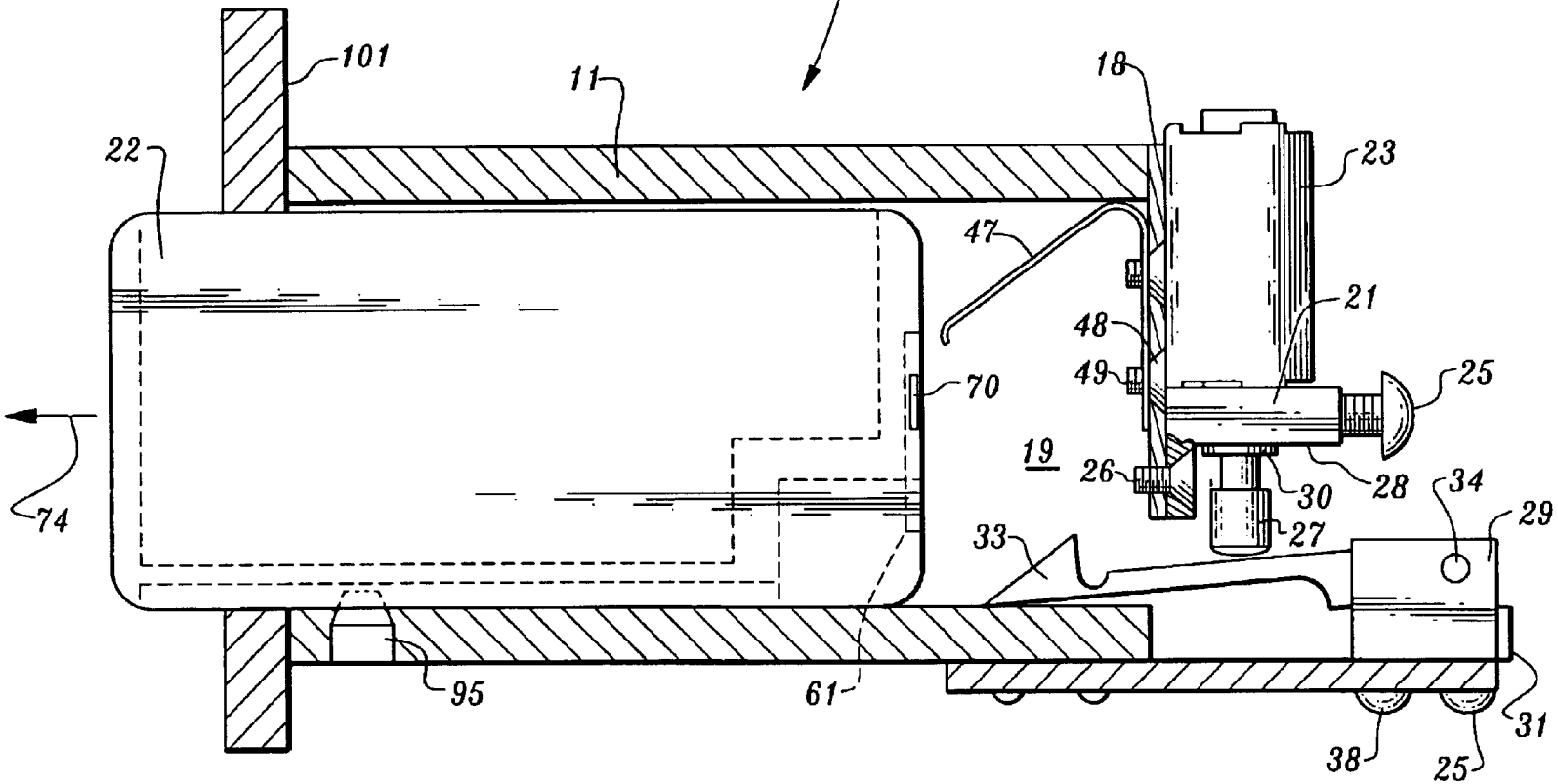
FIG. 9 is a side sectional view through a module of this invention illustrating an individual cartridge and its release mechanism's components.

An inverted L-shaped mounting shelf 21 is secured to the back wall by small screws not visible in this FIGURE, but which can be seen in FIG. 9. To which reference can be simultaneously made. Since there are five cartridges, 5 solenoids 23 are seen linearly aligned. Each solenoid includes an energizing terminal 24 to which is attached a pair of wires 39 and a conventional connector 41. The ram housing 30 is secured into an opening 28 in solenoid mount 21 by a large screw 25. Bottom plate 37 which could be a circuit board for optional features, is also attached by small screw 26 not seen. The module is spaced from the floor by a series of self adhesive attached rubber feet 38, seen better in FIG. 6.

A series of five pivot blocks 29 are spaced from each other and affixed to the bottom wall 37. Each pivot block includes a latch spring, 31, to be described further supra, which respective spring is retained in place by a large screw 25 that is engaged into an unseen threaded opening in the respective pivot block. The pivot blocks are each attached to the bottom wall 37 by a pivot block mount screw 35.

Figure 5:
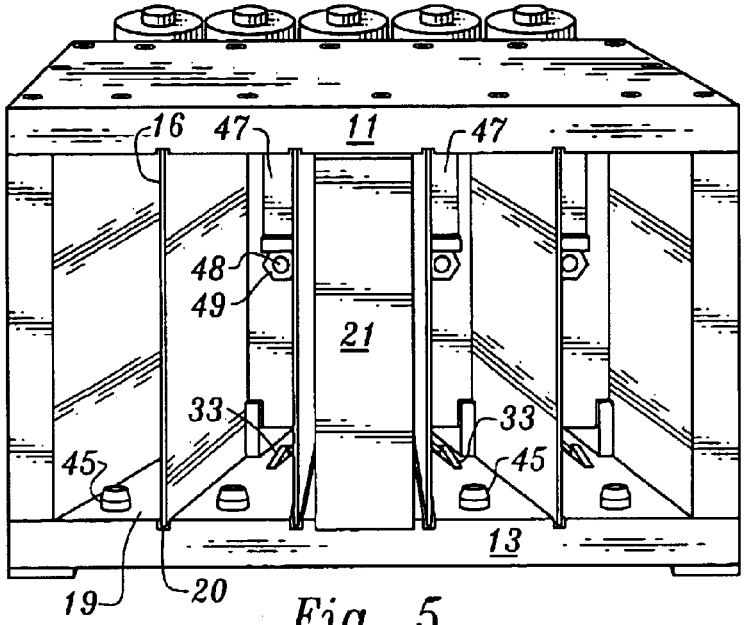
FIG. 5 is a front elevational closeup view of one partially filled module of this invention.

The discussion moves now to FIG. 5 which should be viewed in conjunction with FIG. 9. In FIG. 5 the individual module 10 is seen. Each of the dividers 16 that form a slot 19 for a cartridge 22, are retained in a channel 20 in the top and bottom walls. A stop 45, which serves to also align the individual cartridge 22 is centrally disposed at the front end of each slot 19.

Upon looking inwardly into an individual chamber 19, and by also referring to FIG. 9, one can discern the tilted portion of the latch 33, at the bottom of the chamber, as well as one of the two bolts 48 and its nut 49 that hold the ejection spring 47 of that particular chamber in its place. The second such bolt and nut are not visible in FIG. 5 due to their placement, but see FIG. 9 instead.

Figure 6:
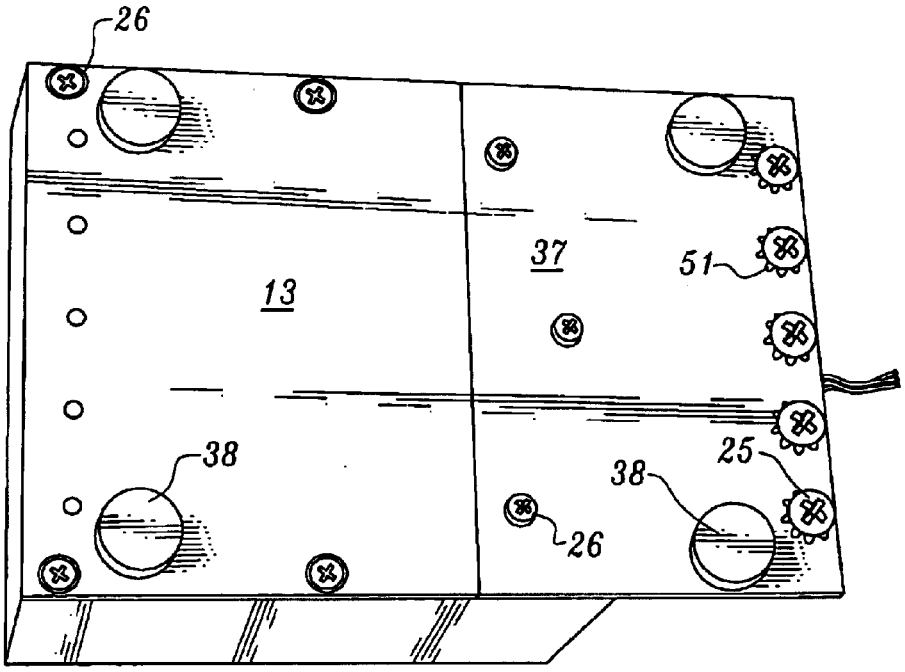
FIG. 6 is a bottom perspective view of the module of this invention.

FIG. 6 is a bottom slightly perspective view of the module of this invention. Here it can be seen that lower bottom plate 37, which overlies bottom wall 13 is attached by small screws 26, which screws could also be recessed in the manner shown for screws 26 that retain the bottom wall 13, if the rear or lower bottom plate were thicker rather than being made of circuit board material. The series of spaced rubber feet 38 which are preferably employed to raise the module up and to provide clearance for large screws 25 are readily seen. These large screws 25, are preferably used with a lock washer 51 to retain the respective pivot block in position. The wiring shown here has already been briefly described.

Figure 7A:
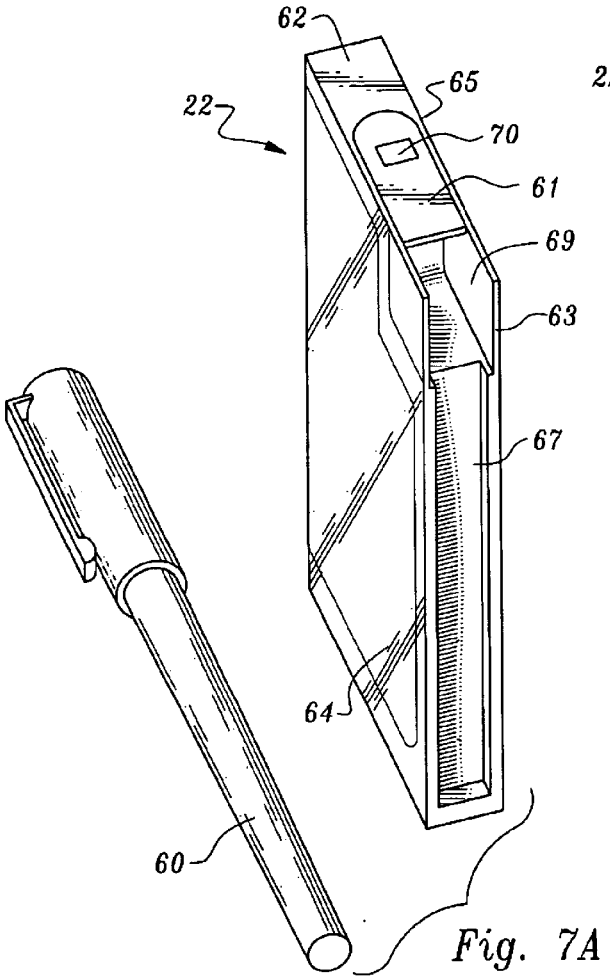
FIG. 7 is a top perspective view of a pair of cartridges according to this invention, wherein the left one adjacent the pen shown for size only and not related to the invention, is a rear perspective view, and the cartridge distant from the pen is a front perspective view.
Figure 7B:
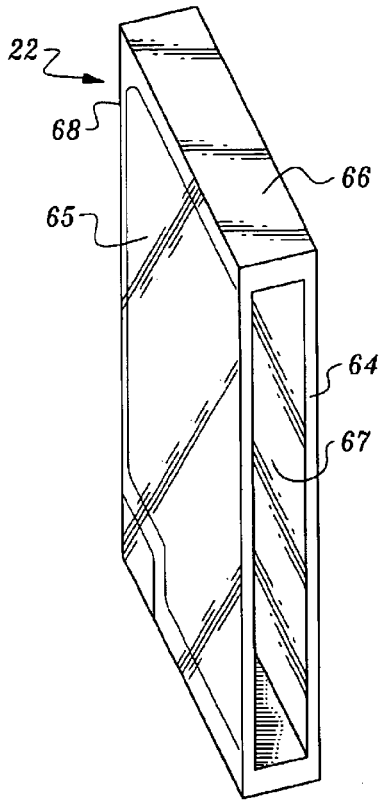

FIG. 7 is divided into two sections, FIG. 7A, which shows the rear and bottom of a cartridge while FIG. 7B is of the front and top of a cartridge 22. Pen 60 which forms no part of this invention is shown for size information only. These cartridges may be clear, translucent or opaque as may be desired. They are formed of two mirror image U-shaped, preferably plastic sections 64, 65 which may be attached to each other as by adhesive or small screws as is desired. The U-shape is seen from the top, per FIG. 8. Each cartridge features an open top wall 68, a recessed guide space 67, which is at the bottom, a rear wall 62 and a front wall 66. A recess zone 63 adapted to receive the latch is found at the rear beneath the metal strip 67 which is retained by adhesive on said rear wall 62. Optional chip 70 or microcircuit 70 can be employed for individual cartridge identification as may be desired using techniques known to the art. Designator 69 is the open portion of the rear wall beneath and below the metal strip 61, that together with the recess zone 63 defines a latch receiver.

Figure 8:
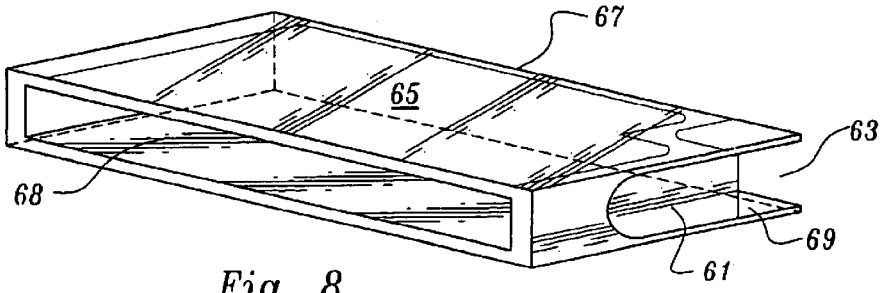
FIG. 8 is a side perspective view of an individual cartridge employed with this invention.

In FIG. 8, a more perspective view of a single cartridge is seen. Here, one can better view the guide space or raceway 67 and its adjacent recess zone 63. Each cartridge may vary from ½" to about 1" wide and from about 2" to 4" in length.

In FIG. 9, the relative positioning of the pivot block 29, the pivot pin 34 from which the latch 33 pivots and the ram 27 which emanates from the solenoid 23 upon the energization thereof are readily seen. Latch spring 31 keeps the latch horizontal until impacted by the moving ram 27 whose force overcomes the spring's retention force, and thus moves the latch to the down position as shown in this view. Housing is seen with one cartridge having been unlatched from latch 33, and having been urged forwardly by spring 47 is seen partly out of the housing 12.

As noted earlier screw 25 retains the solenoid housing in the mount shelf 21.The guide space 67 receives the alignment guide 45 shown elsewhere in the drawings.

When the latch is released from beneath the down hanging metal strip the compressed ejection spring 47 urges the cartridge 22 forward to the position shown in this view. The latch spring returns the latch to the first upright position. See arrow 74. Note the position of the stop 45 which both guides the cartridge and prevents rearward insertion past a certain point upon return to the module.

From an operation perspective, when the accession also known as an actuating means or the computer electronically connected to the accession means, determines which cartridge is to be released from its module, a signal energizes the solenoid. The solenoid plunger momentarily pushes down the latch, and releases the latch from engagement with the cartridge. The cartridge is urged forward by the tension on a leaf spring disposed behind the cartridge. The ejection spring being tensed, relaxes by urging the cartridge forward far enough out of the holder for the user to grasp and remove the cartridge from the slot of the cartridge holder.

After the key, coins, stamps or other small item(s) is removed from the chamber of the cartridge, it is urged back into its slot. The ejection spring 47 is compressed downwardly, and the metal strip re-engages the latch.

When the solenoid is de-energized, the plunger returns inwardly, and the latch spring then relaxes. Since the plunger has returned to its at rest position, the latch returns to the upward at rest position.

Figure 10:
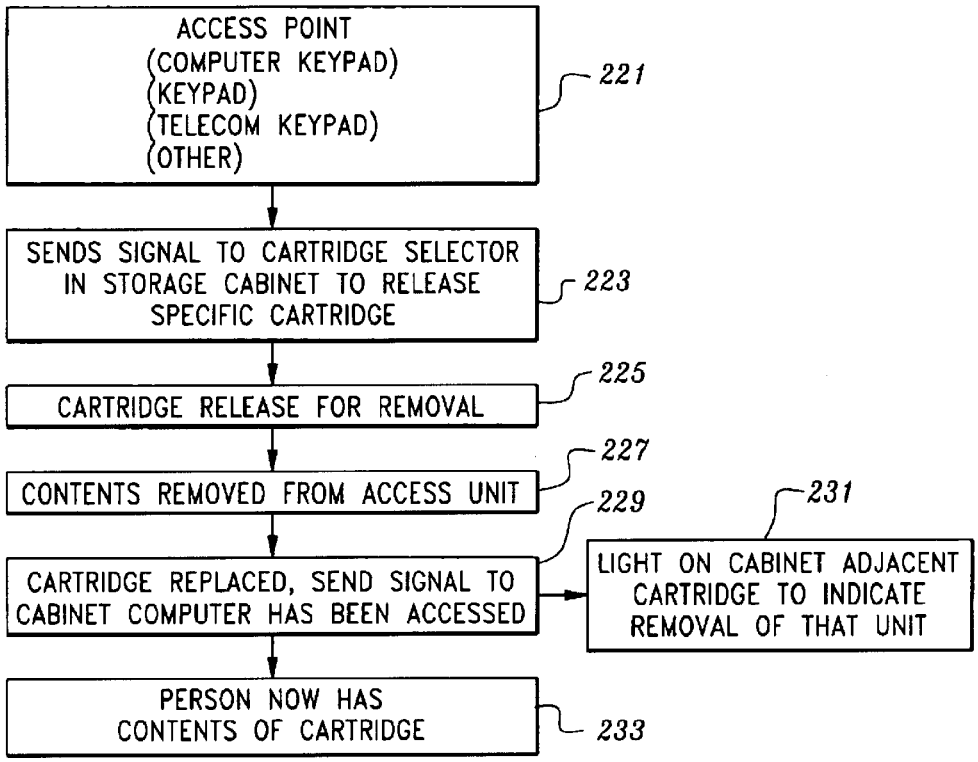
FIG. 10 is a diagrammatic view of the procedure to use the system of this invention to access stored small parts.

When the cartridge, with the contents now removed, is reinserted into the holder, the curved lower rear corner of the cartridge upon insertion rides the latch pawl down, such that the pawl tip will be reinserted into the recess at the base of the cartridge whereby the cartridge is retained in its respective slot for ultimate restocking prior to is next use. Though of course, the contents could be used and replaced immediately into the cartridge prior to reinsertion of the cartridge into the module. An example of such would be the accession to a key to open a strong box. FIG. 10 illustrates the procedure to be followed during the course of the use of the dispenser of this invention. A user with a specific secure mode of access such as but not limited to the modes shown in box 221, utilizes the mode to send an electronic signal to a cartridge selector which is basically a computer to send a signal to release a specific selected cartridge, per box 223.

The cartridge is released for removal per box 225. The cartridge is released in a manner as is discussed elsewhere herein with respect to the discussion of FIG. 9. The user removes the small item contents of the cartridge, per box 2 27, and replaces the cartridge into its housing, box 229. An optional light or other indicia can signal the previous accession of the cartridge 231. The contents are now in the hands of the user, per box 233.

The logic to specifically select an individual cartridge or a next available cartridge are both within the skill of the art. Thus, two types of logic are within the scope of this invention. First, to sequentially select the next available filled cartridge within a module, when all of the cartridges contain like filling material, such as a key to a room, a debit card for a photocopier, etc. No true selectivity is defined. The analogy is to the taking of the next candy bar of the same variety as the previous candy bar.

The other type of logic is to permit one to specifically select one special cartridge within a module because it may have content that differs from the content of the next adjacent cartridge.

As shown in FIGS. 1 and 2, light-emitting diodes or LCD displays can be placed on the faceplate and wired into the circuitry according to techniques known in the art. These indicator means can be electronically connected to be lit up when contents are present and dimmed upon content being removed. Such programmable logic is within the skill of the art.

It is also within the scope of the invention to program the logic such that a 10 key keypad or other alphanumeric pad can specifically select a certain cartridge such as A4 or B5, similar to the nomenclature shown on the faceplate currently. Such alphanumeric pads are known in the art and are used today on stamp vending machines and certain large selection snack food vending machines. Thus further details on how to incorporate such technology into the access point need not be provided.

One item not discussed previously fully is faceplate, 101. This plate is the same as the front wall 101 shown in FIG. 1. The dashed lines, unnumbered thereon, are an indicator of the bolt holes shown in FIG. 1 for mounting the plate.

In the storage cabinet of FIG. 2, it is seen that the cabinet includes a plurality of boxes, each of which has a row of modules each of which contains a plurality of cartridges. These cartridges are released from their respective holders by the utilization of any of the means shown in FIG. 11. All of these accession means offer a secure controlled access to either the storage cabinet in general whereby the computer determines which cartridge is to be released, or the accession means, be it code or mode, can be the manner in which the specifically determined which cartridge is to be released. If the accession means is located at the site of the cartridges, then the accession means can more easily specifically determine which cartridge is to be released from its module. All such permutations are well within the skill of today's computer programmer.

Figure 11:
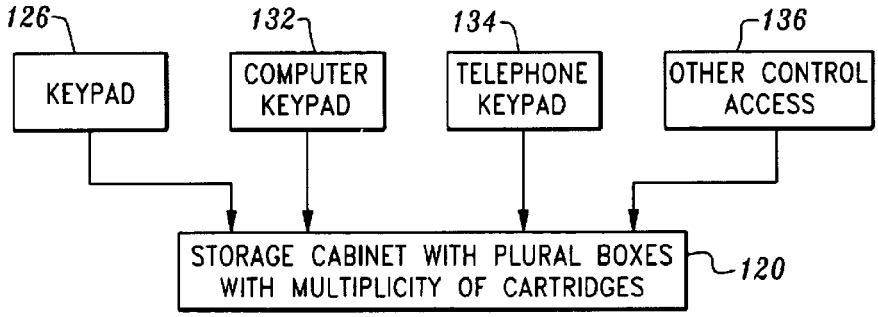
FIG. 11 is a diagrammatic view illustrating a plurality of ways of accessing the storage cabinet that holds a plurality of the modules of this invention.
Figure 12:
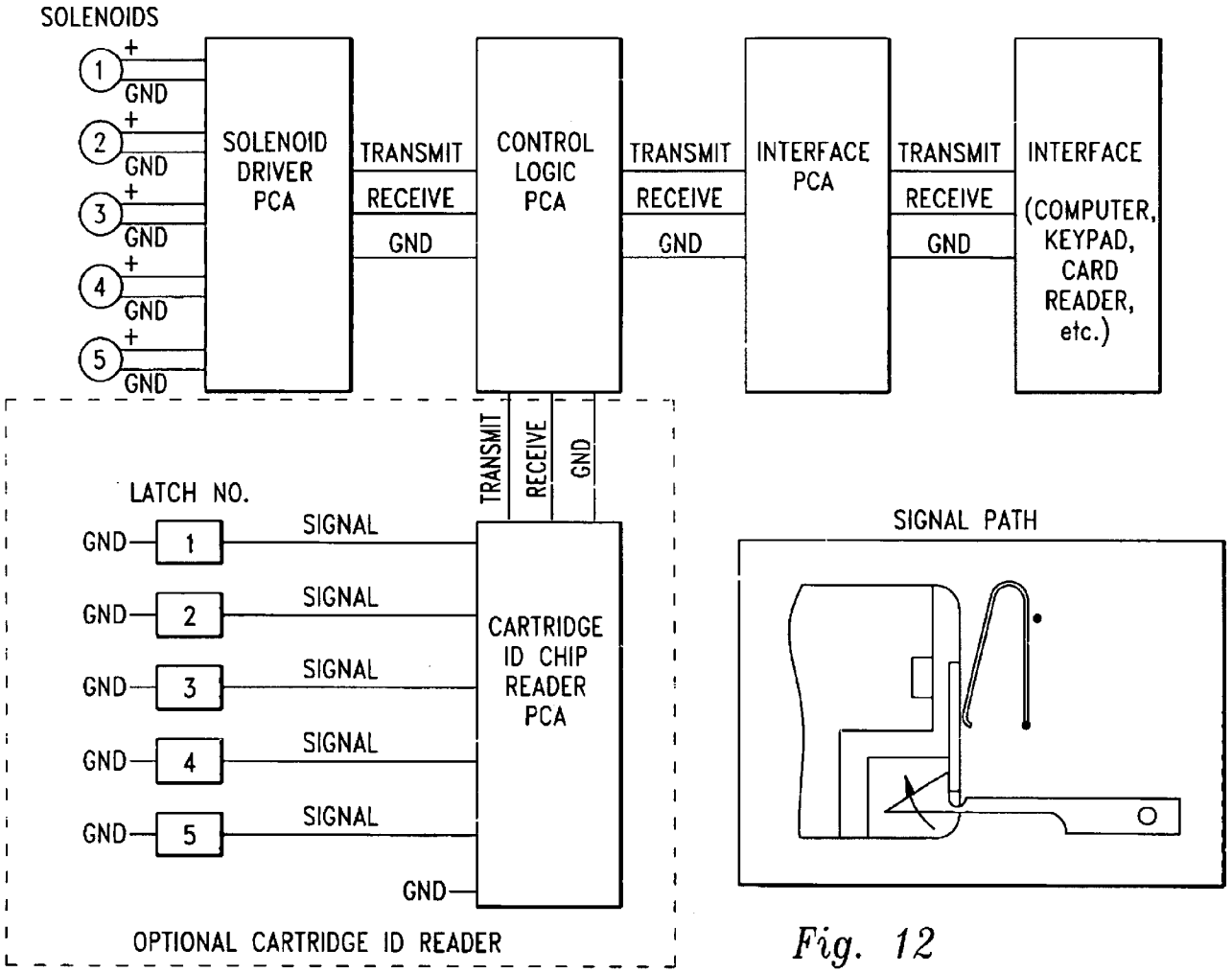
FIG. 12 is an electrical schematic diagram of the circuitry involved for the operation of the access system of this invention.

Reference is made once again to FIG. 2 to viewed in conjunction with FIG. 11. Here in FIG. 11 it is seen that keypad 126 and the other controlled access modes such as the coin and bill receivers shown in FIG. 2, and access modes connected electronically such as computer keypad 131 and telephone keypad 132 all access the storage cabinet depicted as box 120 for release of a cartridge and its contents.

It is seen that I have provided a safe and secure system for the accession of small items that require secure confinement, the retrieval of which can be accomplished by various procedures. Such items include keys, messages, coins, and the like.

Since certain changes may be made in the above described product without departing from the scope of the invention herein involved, and certain changes can also be made in the procedural steps of the process disclosed herein, without departing from the scope of the invention, it is intended that all matter contained in the above description and shown in the accompanying drawings shall be interpreted as illustrative and not in a limiting sense.

I claim:

1. A module for accessing small items, such as a key or token stored in a secure manner in a cartridge residing in said monitor, for controlled access thereto, which module comprises:

a housing having spaced top and bottom walls, and spaced sidewalls, normal thereto, a series of spaced separator walls define a plurality of cartridge slots, adapted to each receive one cartridge, said top and bottom walls each having elongated aligned recesses to receive its respective separator walls to define the plurality of cartridge slots, each being open in the front and closed off in part from the top wall downwardly a finite distance by a rear wall, said rear wall having an inner surface and an outer surface, and having an ejection spring disposed within each cartridge slot on the inner surface of the rear wall;

a solenoid mount plate having a series of aligned openings each opening adapted to receive a portion of a solenoid there through, said solenoid mount plate being attached to the outer surface of the rear wall;

a series of solenoids corresponding one each to the respective cartridge slots, all of said solenoids being attached to said rear wall, and disposed though a respective opening in said solenoid mount plate, pivotal latching means, one per cartridge slot pivotally mounted to said bottom wall and expending beneath said rear wall into a respective cartridge slot for engagement with the cartridge of the respective cartridge slot, means to selectively energize each solenoid, a series of cartridges each sized to be received by a slot within the housing, and each cartridge being open at the top and having a latch receiver at the rear thereof, each latch receiver adapted to engage a latching means, whereby when a solenoid is energized, the solenoid impacts the respective latching means to disengage the latch receiver from the latching means, and said cartridge is urged out of said slot by the ejection spring associated with said slot by the spring moving from a tensed position to an at rest position.

2. In the module of claim 1 wherein the latching means associated with each cartridge is a pivot block disposed rearwardly from the associated solenoid, which solenoid has a plunger, said pivot block having a latch pivotally mounted therein, and retained in an upward position by a latch spring until said latch is moved downwardly by the selective energization of the solenoid"s plunger, at which event the latch is released from engagement with the cartridge.

3. In the module of claim 1 wherein each cartridge is about ½½" to 1" wide and made of plastic, is open at the top, and has a downwardly depending metallic strip extending from the rear wall, and having a recessed zone extending upwardly form the bottom by the rear thereof to define a latch receiver.

4. A system for the storage and release of small articles comprising a plurality of the modules of claim 1 and an actuating means to release said cartridges disposed in said plurality of modules, electronically connected, said modules and said actuating means being disposed in a cabinet.

5. In the module of claim 2 wherein each cartridge is about ½½" to 1" wide and made of plastic, is open at the top, and has a downwardly depending metallic strip extending from the rear wall, and having a recessed zone extending upwardly from the bottom by the rear thereof to define a latch receiver.

6. A series of modules adapted to be retained linearly in a column or row, all of which modules are mounted to a faceplate for disposition within a box for placement in a cabinet, said faceplate having a plurality of openings corresponding in size and number to the total number of cartridge slots of all of the modules, each opening aligned with each slot, said faceplate biding attached to the series of modules, each module having a series of adjacent cartridge slots for receipt of a cartridge to hold small items, each cartridge having a rear latch receiver, a solenoid and a latching means for each cartridge slot, said latching means, being movable from a first position upward to a second position upon the energization of the solenoid, said latching means being in engagement with the latch receiver on its respective cartridge when said cartridge is disposed in its cartridge slot, to retain said cartridge in said slot and means to selectively energize each solenoid.

7. A plurality of faceplate mounted modules of claim 6 disposed within a box for placement in a cabinet, each module having a plurality of cartridges in slots, and means to access each cartridge selectively by at least one of an access mode or an access code, wherein the access mode is electronically connected to each said module and to each cartridge slot selectively, and said access mode includes money receiving and magnetic card actuating means associated therewith and electrically connected thereto.

8. A cabinet having a plurality of boxes, each box comprising a faceplate with a plurality of modules mounted thereto, said cabinet including electronic actuating means for said modules, mounted thereon and electrically connected to selectively actuate each module, said actuating means including at least one of an access code input device and an access mode input device, said access mode input device being selected from the group consisting of at least one of coin receiver, paper bill receiver, and credit/debit card readers, each module having a plurality of removable storage cartridges for holding small items, each cartridge being engageable to latching means forming a part of the module, each latching means serving to retain the respective cartridge within the module, and said latching means being electrically connected to said actuating means.

9. In the cabinet of claim 8 wherein the actuating means also includes an access code input device such as but not limited to a 10 key keypad, an alphanumeric input device, a voice recognition system, and a computer key stroke modem input receiver.

10. In the cabinet of claim 8 wherein each of the modules has a cartridge specific identification means associated with it the cartridge to indicate a storage in use condition, whereby upon selection of an individual cartridge, the identification designator means for that cartridge switches from an on condition to an off condition.

11. A process for accessing small items disposed in a cartridge of a module holding a plurality of cartridges in slots, wherein a plurality of modules are disposed in a cabinet, said cabinet including an actuating means electrically connected to each cartridge slot, which process comprises:

(a) inputting one an access code or access mode to send a signal to a cartridge selector in the cabinet to release a specific cartridge by energizing a solenoid to disengage a latch from the specific cartridge previously selected, (b) removing the cartridge now unlatched to empty the contents therefrom, (c) emptying the contents from the selected cartridge, (d) replacing the cartridge back into its slot in its module.

12. A process for accessing small items in a secure storage module, which process comprises;

(a) inserting a source of monetary value selected from paper money, coins, a debit card and a credit card into an access point to, (b) create an electronic signal to a microprocessor and associated logic to select a specific cartridge disposed within a module, (c) releasing said specific cartridge from its slot in a module by unlatching a latch retaining said cartridge in a slot, (d) removing any item stored in the cartridge, (e) replacing the cartridge into a slot in a module and re-latching the cartridge into the module.

13. A process for accessing small items in a secure storage module, which process comprises:

(a) inputting an access mode code from a source selected from the group consisting of a telephone keypad, a computer keypad electronically linked to an access point and a voice recognition system to send a signal to a cartridge selector to disengage a latch retaining a specific cartridge in a module, (b) urging said cartridge from a slot within a module, for content removal, (c) removing the cartridge's contents, (d) replacing the cartridge back into its slot in its module and relatching the module into place.

* * * * *